United States Patent [19]

Leavens

[11] 4,320,540

[45] Mar. 23, 1982

[54] DISCHARGE DRAIN ASSEMBLY

[75] Inventor: W. Hudson Leavens, Midland, Canada

[73] Assignee: Waltec, Inc., Ontario, Canada

[21] Appl. No.: 203,231

[22] Filed: Nov. 3, 1980

[30] Foreign Application Priority Data

Jul. 24, 1980 [CA] Canada ..... 356946

[51] Int. Cl.[3] ..... A47K 1/14; E03C 1/262

[52] U.S. Cl. ..... 4/287; 4/291; 4/292; 4/295; 4/652

[58] Field of Search ..... 4/286, 287, 288, 290–293, 4/289, 295, 191, 204, 206, 619, 638, 640, 650, 652; 210/163–165; 215/355, 356, 359, 363, 294, 296, 288, 301

[56] References Cited

U.S. PATENT DOCUMENTS

| | | | |
|---|---|---|---|
| 1,783,460 | 12/1930 | Brotz | 4/291 |
| 2,073,899 | 3/1937 | Luther | 4/292 X |
| 2,263,537 | 11/1941 | Fredrickson | 4/287 |
| 2,500,674 | 11/1946 | Gleason | 4/287 |
| 2,512,867 | 2/1948 | Marcussen | 4/287 |
| 2,569,615 | 11/1946 | Link | 4/287 |
| 2,915,762 | 12/1959 | Kiveta | 4/295 |
| 3,800,339 | 4/1974 | Bergin | 4/287 |
| 3,813,708 | 6/1974 | Hamburg | 4/286 |
| 4,232,407 | 11/1980 | Williams | 4/287 |

FOREIGN PATENT DOCUMENTS 882283 9/1971 Canada .

*Primary Examiner*—Stuart S. Levy
*Attorney, Agent, or Firm*—Smart & Biggar

[57] ABSTRACT

Disclosed is a discharge drain assembly (for use in a sink) including a drain body and a plug assembly adapted to fit in the drain body which features limited rotational movement between an open and a closed position. The plug includes a stainless steel strainer with an integral hollow knob having opposed sides which are inwardly concave. The knob securely but releasably retains a slotted head portion of a spindle. The spindle has a neck portion for receiving a sealing washer and a lower body portion including three leg portions. The leg portions support the plug in the open position, restrain rotation in a first direction beyond the open position, and cam the plug to the closed position when rotated in a direction opposite said first direction. The structure substantially eliminates a "finding" problem common in prior art arrangements and provides a good seal in the closed position.

1 Claim, 3 Drawing Figures

DISCHARGE DRAIN ASSEMBLY

BACKGROUND OF THE INVENTION

This invention relates to a discharge drain assembly for use in the outlet of a sink.

The present invention is an improvement over that disclosed and claimed in Canadian Pat. No. 882,283 of Frank E. Dudas, et al issued Sept. 28, 1971. That Patent discloses a discharge drain assembly which includes a drain body adapted to be attached at its upper end to a drain opening in a sink and at its lower end to a waste pipe. A plug assembly is adapted to fit loosely in the drain body for movement between an open position in which waste water is strained as it passes to the waste pipe, and a closed position in which water is sealed in the sink. The plug assembly includes a strainer, a washer and a spindle which has protrusions at its lower end for cooperating with the drain body to hold the plug assembly in the open position. The strainer is located on the spindle above a resilient washer and an integral shoulder on the spindle such that the washer also seals the sink when the plug assembly is in the closed position.

The assembly according to the Patent has a hollow knob and the structure of the strainer is such that there may be difficulty in "finding" the strain position. Furthermore, the method of assembly requires undesirably close tolerances on the rubber washer.

A combined strainer-basket and drain valve is disclosed in U.S. Pat. No. 2,512,867 of K. R. Marcussen issued June 27, 1950. Unlike the present invention, it does not have a unitary knob and strainer but utilizes a separate cap. The plug-body includes a post or shank over which the cup is fitted. A joint is left between the cap and the strainer in which dirt can collect. The cap is a force fit on the plug-shank and it can be disassembled for cleaning the structure. Also, the positioning lugs are straight so that it is necessary to lift the strainer to be able to bring it to the open position. In the present invention, the strainer is turned in one direction to close it and in the other direction to open it. Furthermore, the strainer assembly includes lugs or legs structured so as to prevent rotation beyond the open position, thus alleviating the "finding" problem.

Gleason U.S. Pat. No. 2,500,674 issued Mar. 14, 1950 discloses a sink drain valve having lugs or legs with cam surfaces, but not for rotation along a short cam surface in the closing direction. It is necessary to lift a knob to permit the lugs or legs to clear the spider in the drain body. The stopper is shown to be solid whereas the stopper (rubber washer) used in the present invention has a flexible "skirt" for better sealing action.

Another type of drain assembly is shown in the Link U.S. Pat. No. 2,569,615 issued Oct. 2, 1951. One embodiment does not have legs which rest on the spider legs but rather has a central lifter stem which fits in a central hole in the spider. Another embodiment disclosed does show lugs or legs but they are straight-sided so that it is necessary to lift the strainer in order to turn it to the open position. There is obviously still a "finding" problem.

Fredrickson U.S. Pat. No. 2,263,537 issued Nov. 18, 1941 shows an apparently solid stopper with ribs on the underside and lugs on the upperside which hold the strainer. Again, in this structure, it is necessary to lift as well as rotate the strainer in order to open the drain.

In many known structures, the plug assembly is held in the closed position essentially by gravity and if conditions are not ideal, the plug leaks. To correct this defect, the plug assembly of the present invention includes legs depending from a spindle and having a length such that they "lock" the assembly in place in the seal position by their contact with the bridges of the spider at the bottom of the drain body.

To correct the "finding" fault for the strain position, the legs extend even further so that when the plug assembly is turned counter-clockwise from the seal position to the strain position, there is a positive stop achieved when the bottom part of the leg strikes a bridge between the holes of the spider at the bottom of the sink basket. To ensure that the plug assembly remains in the strain position, each leg has a seat to fit each bridge of the spider. Thus, the invention provides a plug and strainer that provides the user with ease of use, notably in the area of "self-location" to strain or seal position, short and easy turn radius to either strain or seal position (about $\frac{1}{3}$ revolution), positive location of strain and seal position and a plug assembly that locks in the seal position to prevent leaking.

As regards the above mentioned Canadian Pat. No. 882,283, the structure disclosed therein requires that the strainer and spindle be held together by the washer. In the present invention, the washer is held to the spindle by stretching it out into a slot in the spindle. The spindle is attached to the strainer by forcing an expandible protrusion into a hollow knob drawn in the strainer. This provides an easily assembled mechanical attachment of parts that can be disassembled for washer replacement. The invention allows for fairly broad tolerances in the parts and the chance of unintentional separation is minimized.

In the structure of the aforementioned Canadian Pat. No. 882,283, the "hardness" of the solid rubber washer tends to cause improper seating and, therefore, leaking. In the present invention, the washer has a flexible outer skirt which provides a good sealing action.

In the structure of Canadian Pat. No. 882,283, the strainer is turned to attain the locked and sealing position, but the rubber washer rubs against the steel body with some difficulty. In the present invention, the plastic spindle runs easily over the steel bridges of the spider to achieve the locked seal.

As mentioned above, the knob of the spindle of Canadian Pat. No. 882,283 is hollow and its shape is such that dirt can collect and grow in places that are difficult to clean. In the present invention the spindle is solid and has easily cleaned contours.

SUMMARY OF THE INVENTION

According to the present invention, there is provided a discharge drain assembly comprising:

(a) a thin-walled drain body for fitting into a discharge opening in a sink, said drain body comprising:
  (i) an annular generally cup-shaped upper portion, said upper portion extending outwardly from a lower inner diameter to an upper outer diameter;
  (ii) a generally cylindrical lower portion having a diameter substantially equal to said inner diameter and a bottom end adapted to be attached to a waste pipe;
  (iii) an annular shoulder integrally attaching the upper end of said lower portion to said upper portion at said inner diameter;

(iv) three equi-angularly spaced radial bridges extending inwardly from said bottom end of said lower portion and defining annular openings; and (b) a plug assembly adapted to fit relatively loosely in said sink basket for limited rotational movement between an open position in which waste water is free to leave said sink through said waste pipe, and a closed position in which said plug assembly seals said water in said sink, said plug assembly comprising:

(i) a perforated downwardly dished stainless steel strainer having a bottom portion from which an integral hollow oblong-shaped knob extends upwardly, said knob having opposed long sides which are inwardly concave;

(ii) a spindle having a slotted head portion with inwardly concave opposed long sides, said head portion being adapted to be securely but releasably retained within said knob, said spindle having a neck portion below said head portion having a diameter less than the length of the long sides of the head portion, and a large diameter generally cylindrical lower body portion divided into three equi-angularly spaced leg regions, each leg region including a straight downwardly extending lower leg portion engageable with a radial bridge of the sink basket to prevent rotation in one direction when the strainer is in an open position, a circumferentially extending flat portion adapted to rest on a bridge to hold said spindle in the open position, said flat portion being bounded on one side by a short cam portion adapted to lift said spindle upon rotation in a direction opposite to said one direction, and said short cam portion being followed by a relatively long cam portion which cooperates with a radial bridge to move said spindle downwardly when said spindle is rotated in said opposite direction;

(iii) a resilient sealing washer having a flat upper wall and a downwardly extending inwardly tapered outer skirt portion, said upper wall having a hole whereby the washer can be secured to the neck portion of the spindle by passing it over the head portion thereof, the skirt portion being adapted to seal against the shoulder portion of the sink basket when the strainer is in the closed position.

DESCRIPTION OF THE PREFERRED EMBODIMENT

Figure 1:
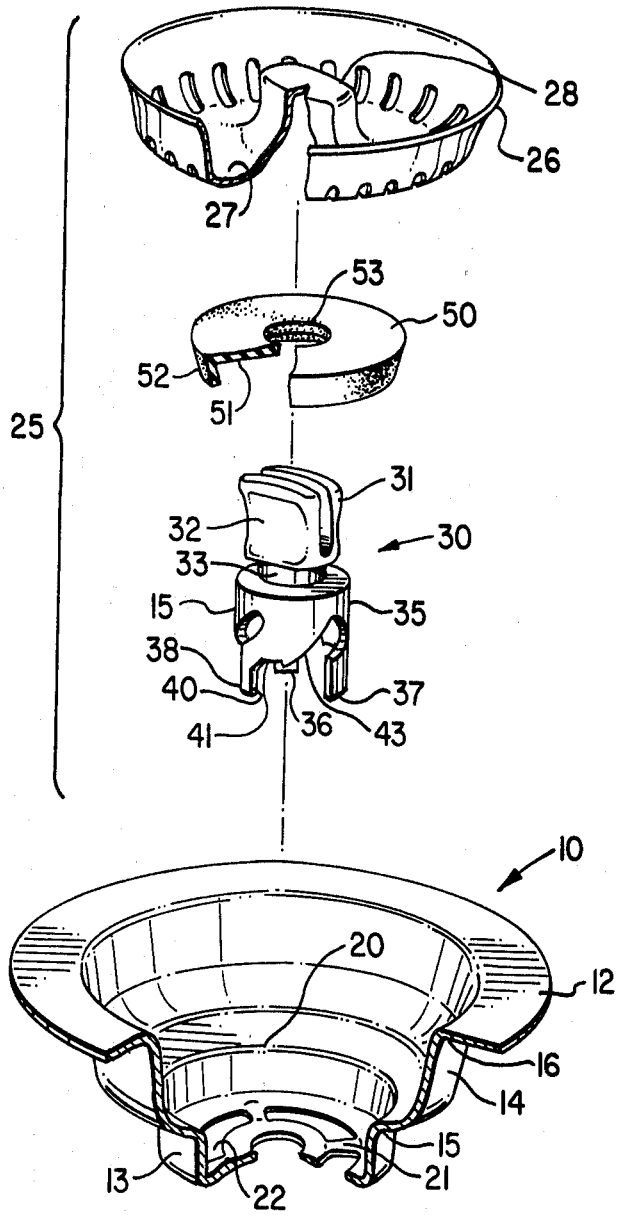
FIG. 1 is an exploded view, partially in cross-section, of a discharge drain assembly according to the present invention.

Referring to FIG. 1, the discharge drain assembly according to the present invention is seen to comprise a drain body 10 which is adapted to be attached, by upper portion 12, to a sink 11 (FIGS. 2 and 3) by any suitable conventional means and, at its lower end 13 to a conventional waste pipe, not shown.

The thin-walled sink basket 10 comprises an annular generally cup-shaped upper portion 14 extending outwardly from a lower inner diameter 15 to an upper outer diameter 16.

The generally cylindrical lower portion 13 has a diameter substantially equal to the inner diameter 15 and the bottom end is adapted to be attached to a waste pipe. An annular shoulder 20 integrally attaches the upper end of the lower portion 13 to the upper portion 14 at the inner diameter 15.

Three equi-annularly spaced radial bridges 21 extend inwardly from the bottom end of the lower portion 13 and define annular openings 22.

The plug assembly 25 is adapted to fit relatively loosely in the drain body 10 for limited rotational movement between an open position (FIG. 3) in which waste water is free to leave the sink through the waste pipe, and a closed position (FIG. 2) in which the plug assembly 25 seals water in the sink.

Figure 2:
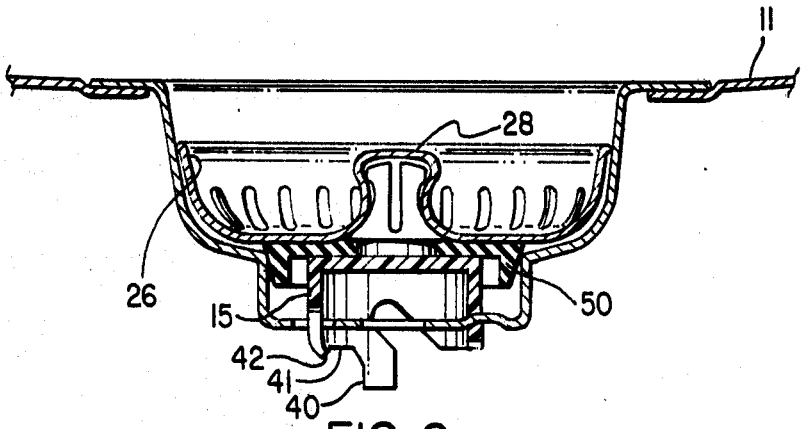
FIG. 2 is a cross-sectional view of the discharge drain assembly according to the present invention, showing the closed position.
Figure 3:
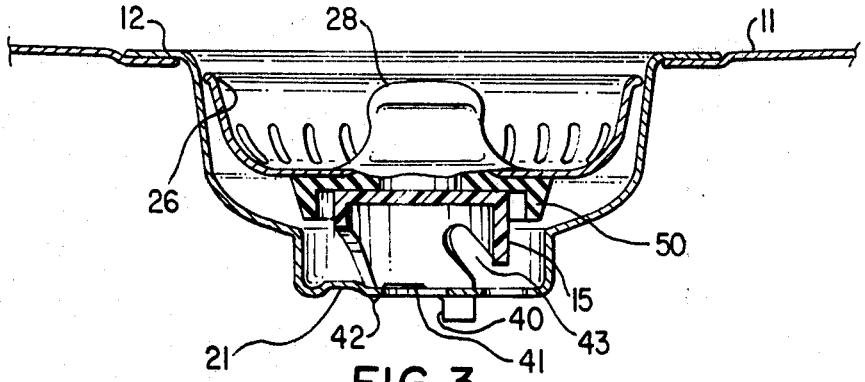
FIG. 3 is a diagram partially in cross-section, showing the plug in the open position.

The plug assembly 25 comprises a perforated downwardly dished stainless steel strainer 26 having a bottom portion 27 from which an integral hollow oblong-shaped knob 28 extends upwardly, the knob having opposed long sides which are inwardly concave, as best seen in FIGS. 2 and 3. A spindle 30 has a slotted head portion 31 with inwardly concave opposed long sides 32, as best shown in FIG. 1. The head portion 32 is adapted to be securely but releasably retained within the knob 28. The spindle 30 has a neck portion 33 below the head portion 31 having a diameter less than the length of the long side 32 of the head portion 31, and a larger diameter generally cylindrical lower body portion 35 divided into three equi-angularly spaced leg regions 36, 37 and 38. Each leg region includes a straight downwardly extending lower leg portion 40 engageable with a radial bridge 21 of the sink basket to prevent rotation in one direction (in this case counter-clockwise) when the plug assembly is in an open position. Each leg also includes a circumferentially extending flat portion 41 adapted to rest on a bridge 21 to hold the spindle in the open position. The flat portion 41 is bounded on one side by a short cam portion 42 (FIGS. 2 and 3) adapted to lift the spindle upon rotation in a clockwise direction, the short cam portion 42 being followed by a relatively long cam portion 43 which co-operates with a bridge 21 to move the spindle downwardly when the spindle is rotated in the clockwise direction.

The embodiment shown in the drawings is adapted to close upon clockwise rotation and open upon counter-clockwise rotation but, obviously, the structure could be reversed for closure upon counter-clockwise rotation and opening upon clockwise rotation.

A resilient sealing washer 50 has a flat upper wall 51 and a downwardly extending inwardly tapered outward skirt portion 52, the upper wall 51 having a hole 53 whereby the washer 50 can be secured to the neck portion 33 of the spindle 30 by passing it over the head portion thereof, the skirt portion 52 being adapted to seal against the shoulder portion 20 of drain body when the strainer is in the closed position.

What I claim as my invention is:

1. A discharge drain assembly comprising:

(a) a thin-walled drain body for fitting into a discharge opening in a sink, said drain body comprising:

(i) an annular generally cup-shaped upper portion, said upper portion extending outwardly from a lower inner diameter to an upper outer diameter;

(ii) a generally cylindrical lower portion having a diameter substantially equal to said inner diameter and a bottom end adapted to be attached to a waste pipe;

(iii) an annular shoulder integrally attaching the upper end of said lower portion to said upper portion at said inner diameter;

(iv) three equi-angularly spaced radial bridges extending inwardly from said bottom end of said lower portion and defining annular openings; and (b) a plug assembly adapted to fit relatively loosely in said drain body for limited rotational movement between an open position in which waste water is free to leave said sink through said waste pipe, and a closed position in which said plug assembly seals said water in said sink, said plug assembly comprising:

(i) a one piece perforated downwardly dished stainless steel strainer having an imperforate bottom portion from which an integral hollow oblong-shaped imperforate knob extends upwardly, said knob having opposed long sides which are inwardly concave;

(ii) a spindle having a slotted head portion with inwardly concave opposed long sides, said head portion being adapted to be securely but releasably retained within said knob, said spindle having a neck portion below said head portion having a diameter less than the length of the long sides of the head portion, and a larger diameter generally cylindrical lower body portion divided into three equi-angularly spaced leg regions, each leg region including a straight downwardly extending lower leg portion engageable with a radial bridge of the sink basket to prevent rotation in one direction when the strainer is in an open position, a circumferentially extending flat portion adapted to rest on a bridge to hold said spindle in the open position, said flat portion being bounded on one side by a short cam portion adapted to lift said spindle upon rotation in a direction opposite to said one direction, and said short cam portion being followed by a relatively long cam portion which cooperates with a radial bridge to move said spindle downwardly when said spindle is rotated in said opposite direction, each said downwardly extending lower leg portion extending below said short and long cam portions;

(iii) a resilient sealing washer having a flat upper wall and a downwardly extending inwardly tapered outer skirt portion, said upper wall having a hole whereby the washer can be secured to the neck portion of the spindle by passing it over the head portion thereof, the skirt portion being adapted to seal against the shoulder portion of the drain body when the strainer is in the closed position.

* * * * *